US008506050B2

(12) United States Patent
Cringus et al.

(10) Patent No.: US 8,506,050 B2
(45) Date of Patent: Aug. 13, 2013

(54) WETTING CONTROL BY ASYMMETRIC LAPLACE PRESSURE

(71) Applicant: OCE-Technologies B.V., Venlo (NL)

(72) Inventors: Gheorghe D. Cringus, Venlo (NL); Marcus J. Van Den Berg, Venlo (NL)

(73) Assignee: OCE-Technologies B.V., Venlo (NL)

( * ) Notice: Subject to any disclaimer, the term of this patent is extended or adjusted under 35 U.S.C. 154(b) by 0 days.

(21) Appl. No.: 13/662,241

(22) Filed: Oct. 26, 2012

(65) Prior Publication Data

US 2013/0050341 A1 Feb. 28, 2013

Related U.S. Application Data

(63) Continuation of application No. PCT/EP2011/057049, filed on May 3, 2011.

(30) Foreign Application Priority Data

May 10, 2010 (EP) ..... 10162454

(51) Int. Cl.
*B41J 2/135* (2006.01)

(52) U.S. Cl.
USPC ..... 347/45; 347/46; 347/47

(58) Field of Classification Search
USPC ..... 347/40, 42, 45–47
See application file for complete search history.

(56) References Cited

U.S. PATENT DOCUMENTS

| | | | | |
|---|---|---|---|---|
| 5,949,454 | A * | 9/1999 | Nozawa et al. | 347/45 |
| 6,637,868 | B2 * | 10/2003 | Yamamoto et al. | 347/68 |
| 2010/0265297 | A1 | 10/2010 | Park et al. | |

FOREIGN PATENT DOCUMENTS

| | | | |
|---|---|---|---|
| EP | 2 072 261 | A2 | 6/2009 |
| JP | 2007-245549 | A | 9/2007 |
| WO | WO 2008/079878 | A1 | 7/2008 |

* cited by examiner

*Primary Examiner* — Thinh Nguyen
(74) *Attorney, Agent, or Firm* — Birch, Stewart, Kolasch & Birch, LLP

(57) ABSTRACT

A print head configured for ejecting droplets of ink comprises a nozzle surface having arranged thereon at least one nozzle and a pattern of wetting sections and anti-wetting sections, arranged around the nozzle. The wetting sections interchange on a circular line, concentric with the nozzle, with anti-wetting sections. The pattern of wetting sections and anti-wetting sections is configured such that it provides a driving force for droplets to move away from the nozzle. The invention further relates to a printing apparatus, comprising said nozzle.

13 Claims, 8 Drawing Sheets

WETTING CONTROL BY ASYMMETRIC LAPLACE PRESSURE

This application is a Bypass Continuation of PCT International Application No. PCT/EP2011/057049 filed on May 3, 2011, which claims priority under 35 U.S.C. §119(a) to Patent Application No. 10162454.2 filed in Europe on May 10, 2010, all of which are hereby expressly incorporated by reference into the present application.

The present invention relates to a print head configured for ejecting droplets of ink comprising a pattern of anti-wetting material and an ink jet printer comprising said print head.

BACKGROUND OF THE INVENTION

In a known print head, the print head comprises a surface having arranged therein at least one nozzle. Ink is ejected from the print head through said nozzle. When printing, ink may be spilled on the nozzle surface of the print head. Ink present on the nozzle surface close to a nozzle may have a negative influence on the performance of a print head during jetting of the ink. Therefore, it is important to prevent presence of ink on the nozzle surface close to a nozzle.

It is known to prevent ink to be present close to a nozzle by applying an anti-wetting coating around a nozzle. This prevents the formation of an ink film. Instead, ink that comes into contact with the anti-wetting coating will form a droplet, having a relatively small contact area with the coating. However, absent any driving force, the droplets may stay on the anti-wetting coating. If a droplet is present on the anti-wetting coating near the nozzle, this may still have a negative influence on the jetting performance. Therefore, a driving force is needed to remove ink droplets from the surface of the print head. Moreover, it is necessary to prevent droplets of ink present on the surface to move back to a nozzle.

WO 2008/079878 describes patterns of anti-wetting coating applied on the surface of a fluid ejector. Various patterns, containing anti-wetting coating and uncoated, wetting regions are described. However, no driving force is generated in order to remove the ink further away from the nozzles and additional means are needed to remove the ink. In the cited document, this is done by moving a wiper to and fro at a predetermined distance from the surface.

EP 2 072 261 describes an orifice plate for an ink jet print head, wherein an anti-wetting gradient is created on the surface of the orifice plate and wherein the wettability increases gradually with increasing distance from the edge of the orifice. In this way, a driving force is created for moving droplets of ink away from a nozzle and no wiper is needed to remove the ink. However, because of the shape of the pattern, droplets of ink, especially larger droplets of ink may move back towards the nozzle. Therefore, improvement of the pattern of anti-wetting material around a nozzle is needed still. Moreover, an anti-wetting gradient according to EP 2 072 261 is difficult to apply on a nozzle surface.

It is an object of the invention to provide a print head comprising a pattern of anti-wetting material, wherein the pattern is shaped such that a driving force is created to remove ink from a nozzle.

SUMMARY OF THE INVENTION

The object of the invention is achieved in a print head configured for ejecting droplets of ink, said print head having a nozzle surface, said nozzle surface comprising a nozzle and a pattern arranged around the nozzle, the pattern comprising an anti-wetting section and a wetting section, and the pattern having an inner periphery and an outer periphery, the anti-wetting section and the wetting section each extending from the inner periphery to the outer periphery, the anti-wetting section alternating, on a circular line concentric with the nozzle, with the wetting section, wherein the anti-wetting section has a width at the outer periphery larger than a width of a wetting section at the outer periphery.

A print head, used in an ink jet printer, comprises a nozzle surface, which comprises a nozzle. Ink is ejected through the nozzle onto a receiving member. Ink may be spilled on the nozzle surface. Ink present on the nozzle surface may interact with ink that is ejected through the nozzle, thereby influencing the jetting performance of the print head. To prevent the jetting performance being influenced by ink present on the nozzle surface, the ink should be removed from the vicinity of the nozzle. In the present invention, ink is removed from the vicinity of the nozzle by providing a pattern around the nozzle. The pattern consists of a wetting section and an anti-wetting section. In the wetting section, the contact angle between a droplet of ink and the nozzle surface is smaller than in the anti-wetting section. Consequently, the interaction between a droplet and a wetting section of the surface is stronger than the interaction between a droplet and an anti-wetting section of the surface and thus, a droplet of ink prefers to reside on a wetting section, instead of on an anti-wetting section of the nozzle surface.

The pattern has an inner periphery and an outer periphery. The inner periphery being a boundary of the pattern near the nozzle. The outer periphery being a boundary of the pattern further away from the nozzle. The wetting section and the anti-wetting section extend from the inner to the outer periphery. The nozzle is located in the region surrounded by the inner periphery. A virtual, circular line may be drawn around the nozzle, which is concentric with this nozzle. On this circular line, the anti-wetting section alternates with the wetting section.

Close to the inner periphery, the width of a wetting section may be small. In other words, the distance between two adjacent anti-wetting sections on a circular line concentric with the nozzle may be small. The width of a wetting section increases with increasing distance from the nozzle. A small droplet of ink may be accommodated on a wetting section, close to the inner periphery. However, in case the size of the droplet increases, for example by merging of two or more smaller droplets of ink, the droplet may not be accommodated anymore on the part of the wetting section having a small width, but may move to a part of the wetting section having a larger width. Thus, the droplet moves away from the nozzle upon increasing size of the droplet. Consequently, this pattern generates a driving force for droplets to move away from a nozzle upon increasing droplet size, thereby preventing interaction between the droplet on the surface and droplets generated for ejection from the nozzle. The ink may be guided to a cleaning point situated at the edge of a nozzle plate, for example.

The driving force generated by the pattern may depend for example on the size and shape of the pattern, on the properties of the ink and on the properties of the anti-wetting sections on the nozzle surface. By suitably selecting these parameters, as well as other relevant parameters, the driving force generated by the pattern may be such that the magnitude of this driving force exceeds the magnitude on the gravity acting on the droplet and consequently, the driving force generated by the pattern may enable droplets to move uphill. Therefore, the pattern comprising the wetting section and the anti-wetting section in accordance with the present invention may effectively remove ink from a nozzle, even if the nozzle surface is arranged in a (partially) vertical position.

At the outer periphery, the width of an anti-wetting section is larger than the width of a wetting circular section. This is an additional prevention for large droplets to move back from a region outside the outer periphery of the pattern of anti-wetting section to a wetting section, approaching a nozzle. In case the width of the anti-wetting section at the outer periphery of the pattern is much smaller than the width of a wetting section at the outer periphery of the pattern, then the anti-wetting area present in close proximity to the outer periphery may be much smaller than the wetting area in close proximity to the outer periphery. In this case, the anti-wetting area may be relatively small in comparison to the size of a large droplet present on the nozzle surface. Thus, if a large droplet is present outside of the outer periphery, close to the outer periphery, the small anti-wetting area may not suffice to withhold the droplet from moving across the outer periphery of the pattern towards the nozzle the droplet may overlap with a part of the anti-wetting section. As a consequence, a pattern having an anti-wetting section having a small width at the outer periphery of the pattern, is less efficient to prevent ink from approaching the nozzle.

In an embodiment, the inner periphery is circular. A nozzle typically has a circular shape on a nozzle surface. To adjust the shape of the inner periphery of the pattern to the shape of the nozzle it surrounds, the inner periphery of the pattern may have the same shape as the nozzle. However, the shape of the nozzle and the shape of the inner periphery do not need to be the same.

In an embodiment, the pattern is concentric with the nozzle. Both the inner and the outer periphery are circular and both the inner and the outer periphery are concentric with the nozzle. As a consequence, the distance between the nozzle and the peripheries are equal for each point on the inner periphery. Also the distance between the outer periphery and the inner periphery is equal for each point both on the inner and outer periphery. Therefore, the distance that a droplet of ink needs to cover to travel from the inner periphery to the outer periphery is equal for all areas of the pattern. Consequently, the droplets of ink are removed away from the nozzle equally in all directions.

In an embodiment, the outer periphery of the pattern has a diameter, said pattern comprising a number of wetting sections, and wherein each wetting section has a center point located on the inner periphery of the pattern, and a first and a second outer border point located on the outer periphery of the pattern adjacent to a respective anti-wetting section, two virtual lines being located in the wetting section, a first virtual line extending from the first outer border point to the center point and a second virtual line extending from the second outer border point to the center point and wherein an angle θ is defined as the angle between the first and the second virtual lines and wherein $$0 < \theta < 2\arctan\left[\sin\left(\frac{\pi}{2N}\right)\Big/\left(\cos\left(\frac{\pi}{2N}\right) - \frac{d_r}{d_p}\right)\right].$$

The angle θ is larger than zero. If the angle θ is zero, there is no wetting section interchanging with an anti-wetting section on the outer periphery. This results in the absence of a driving force for droplets to move from the inner to the outer periphery. Hence, ink may stay on the anti-wetting sections around a nozzle. In case the $$\text{angle } \theta \text{ equals } 2\arctan\left[\sin\left(\frac{\pi}{2N}\right)\Big/\left(\cos\left(\frac{\pi}{2N}\right) - \frac{d_r}{d_p}\right)\right],$$

the maximum angle θ ($\theta_{max}$) is reached. At $\theta_{max}$, the width of a wetting section at the outer periphery is equal to the width of an anti-wetting section at the outer periphery. If θ exceeds $\theta_{max}$, then the width of the wetting section at the outer periphery of the pattern is larger than the width of the anti-wetting section at the outer periphery of the pattern. If θ has a value between zero and $\theta_{max}$, the wetting section has a width at the outer periphery, that is both larger than zero and that is smaller than the width of the anti-wetting section at the outer periphery. The actual width of the anti-wetting section at the outer periphery is defined by the value of θ, amongst others. Thus, by varying θ, the width of the anti-wetting section at the outer periphery may be adjusted.

In an embodiment, the wetting section has a limited width on the inner periphery of the pattern and the center point is located on the inner periphery in the middle of two adjacent anti-wetting sections. This results in a wetting section being line symmetrical about a line extending from the center point to a point on the outer periphery, said point being in the middle of two outer border points.

In an embodiment, the nozzle has a radius and the inner periphery of the pattern has a radius, said radius of the nozzle being smaller than said radius of the inner periphery of the pattern. In this embodiment, there is a space between the nozzle and the inner periphery of the pattern.

In an embodiment, the area confined by the inner periphery of the pattern and the nozzle is anti-wetting. Thus, the nozzle is surrounded by an anti-wetting region. Consequently, any fluid that may be present just outside of the nozzle, does not spread over the surface, but remains on the anti-wetting surface as a droplet having a small contact area with the nozzle surface. When the size of the droplet increases, for example by merging of two smaller droplets, the droplet may reach the inner periphery of the pattern and may experience the driving force created by the pattern to move away from the nozzle. Further, any droplet present on the pattern will not move towards the nozzle.

In an embodiment, the radius of the nozzle and the radius of the inner periphery of the pattern are equal. In case it is desired that a droplet of ink is removed from an area close to a nozzle immediately, by means of the wetting gradient provided by the pattern, the pattern may be designed such that the inner periphery is as large as the nozzle. In this case, any ink close to a nozzle may experience a driving force to move away from the nozzle, which driving force is provided by the pattern. It is prevented that a droplet of ink stays in the area close to a nozzle.

In an embodiment, the width of a wetting section at the inner periphery is zero. The smaller the width of a wetting section at the inner periphery of a pattern, the more difficult it is for a droplet to be in close proximity to the inner periphery. Hence, a droplet may experience a stronger driving force to move away from the inner periphery and thus, to move away from a nozzle. As a consequence, a pattern, wherein the width of a wetting section at the inner periphery of the pattern is zero, may be more efficient in removing droplets from an area close to a nozzle.

In an embodiment, a part of the surface of the print head outside of the outer periphery of the pattern of anti-wetting sections around a nozzle is as wettable as or more wettable than the wetting section of said pattern. The wettability of a surface is correlated to the contact angle between a surface and a droplet present on that surface. The more wettable the surface is, the smaller is the contact angle. The smaller the contact angle, the more spreading of the droplet of fluid over the surface. Thus, if a part of the surface of a print head outside of the outer periphery of the pattern is more wettable than the wetting section of the pattern, then the contact angle between a droplet of ink and the wetting section of the pattern is smaller than the contact angle between the droplet of ink and the part of the surface outside of the outer periphery of the pattern. If a part of the surface of the print head outside of the outer periphery of the pattern is as wettable as the wetting section of the pattern, then the contact angles between the nozzle surface and the droplet of ink are equal for both areas.

The pattern provides a driving force for a droplet of ink to move away from a nozzle. Gradually, a droplet of ink, present on a wetting section of the pattern moves away from the nozzle towards the outer periphery of the pattern because of this driving force.

Eventually, a droplet should cross the outer periphery of the pattern and leave the pattern. Therefore, the surface of the print head outside of the outer periphery of the pattern should be at least as wettable as a wetting section of the pattern. If the surface outside of the periphery would be less wettable than a wetting section of the pattern, a droplet of ink would stay on a wetting section of the pattern, instead of moving outside of the outer periphery. In this way, ink accumulates on the pattern around the nozzle and this would negatively influence the performance of a print head. If the surface outside of the periphery would be as wettable as a wetting section of the pattern, a droplet of ink may move from a wetting section to an area outside of the outer periphery. If the surface outside of the periphery would be more wettable than a wetting section of the pattern a driving force would be provided for a droplet of ink to move across the outer periphery to an area outside of the pattern. In this way, two additional driving forces are present to remove ink from the area close to a nozzle; a first driving force provided by the pattern and a second driving force provided by the better wettability of the surface outside of the outer periphery of the pattern with respect to the wettability of a wetting section of the pattern. The improved wettability of the print head surface may be provided by a coating, for example. This coating should have high wettability for the ink. Different coatings may be used, depending on the properties of the ink. In general, it is noted that the wettability of a surface may be controlled by any suitable means and/or method such as, but not limited to, application of a coating or any surface treatment.

In an aspect, the present invention further comprises a printer, said printer comprising a print head according to the present invention.

BRIEF DESCRIPTION OF THE DRAWINGS

These and further features and advantages of the present invention are further explained hereinafter with reference to the accompanying drawings showing non-limiting embodiments and wherein.

In the drawings like reference numbers refer to like elements.

DETAILED DESCRIPTION OF THE DRAWINGS

Figure 1:
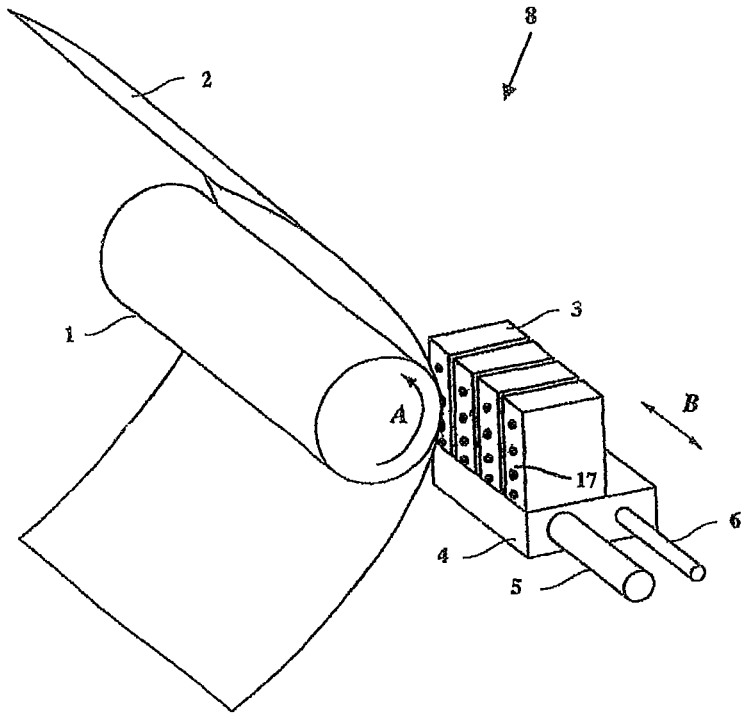
FIG. 1 shows a schematic perspective view of an ink jet printer.

FIG. 1 shows an inkjet printer 8 comprising a platen 1 for supporting an image-receiving member 2 and moving the image receiving member 2 along a number of print heads 3 provided with ink.

A scanning print carriage 4 carries a number of print heads 3 and is moveable in reciprocation in the main scanning direction, i.e. the direction indicated by the double arrow B, parallel to the platen 1, so as to enable scanning of the image-receiving member 2 in the main scanning direction.

The platen 1 is rotatable about its axis as indicated by arrow A. The image-receiving member 2 may be a medium in web or in sheet form and may be composed of e.g. paper, cardboard, label stock, plastic or textile. Alternatively, the image-receiving member 2 may also be an intermediate member, endless or not. Examples of endless members, which may be moved cyclically, are a belt or a drum.

The carriage 4 is guided on rods 5, 6 and is driven by suitable means (not shown), to move the carriage in the main scanning direction B. Each print head 3 comprises a number of nozzles 7 arranged in a single linear array parallel to the sub scanning direction. Four nozzles 7 per print head 3 are depicted in FIG. 1, however in a practical embodiment up to several hundreds of nozzles 7 may be provided per print head 3, optionally arranged in multiple arrays.

The image dots are formed by ejecting droplets of ink from the nozzles 7. Upon ejection of the ink, some ink may be spilled and stay on the nozzle surface of the print head. The ink present close to a nozzle, may negatively influence the ejection of droplets and thus the placement of these droplets on the receiving member 2. Therefore, it is preferred to remove excess away from the nozzle. The excess of ink may be removed by employing a pattern of anti-wetting sections around a nozzle. The pattern generates a driving force for the ink to move away from the nozzle.

Figure 2A:
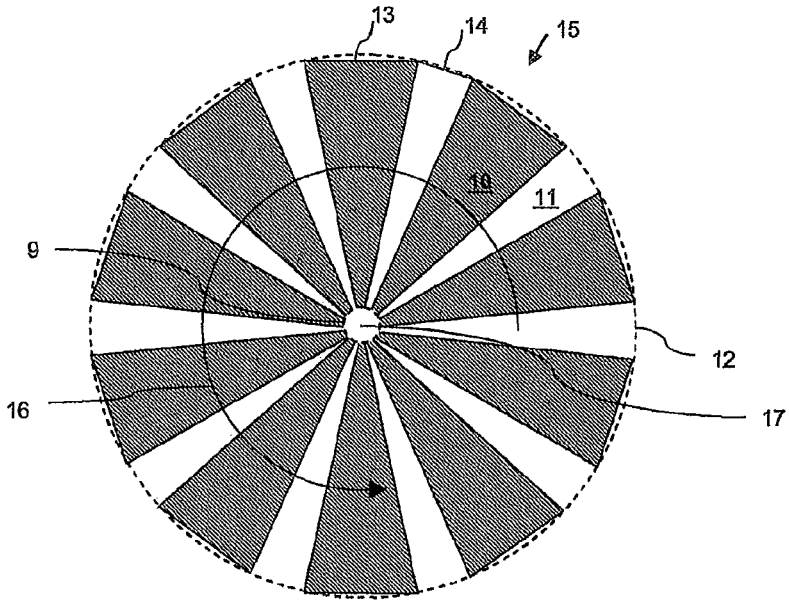
FIG. 2A shows a first exemplary embodiment of a pattern of anti-wetting sections in accordance with the present invention.

FIG. 2A shows an embodiment of a pattern 15 of anti-wetting sections 10. The pattern is applied around a nozzle 17.

The pattern has an inner periphery 9 and an outer periphery 12. The inner periphery may be outside of or coincide with the border of the nozzle 17. The anti-wetting sections 10 extend from the inner periphery 9 of the pattern to the outer periphery 12 of the pattern. The anti-wetting sections 10 alternate with wetting sections 11 on a circular line 16 concentric with the nozzle. The anti-wetting sections 10 have a width 13 at the outer periphery 12 that is larger than the width 14 of a wetting section at the outer periphery 12, in accordance with the present invention. In case ink is spilled on the nozzle surface during jetting, ink is removed away from the nozzle 17 by the driving force generated by the pattern of anti-wetting sections 10. Ink droplets present on a wetting section 11 tend to spread out over the surface, because of the relatively low surface tension of a wetting surface. If the ink reaches a frontier between a wetting section 11 and an anti-wetting section 10, the ink droplet tends to stay in the wetting section 11. The width 14 of the wetting section increases with increasing distance from the nozzle 17. The larger the amount of ink present on a part of the nozzle surface, the larger will be the surface covered with the ink. Since ink tends not to migrate from a wetting section 11 to an anti-wetting section 10, the ink will migrate towards the part of the wetting section 11 having the larger width 14. Thus, upon increasing droplet size, the ink moves away from a nozzle 17 until it reaches a part of the nozzle surface outside the outer periphery 12 of the pattern 15.

Figure 2B:
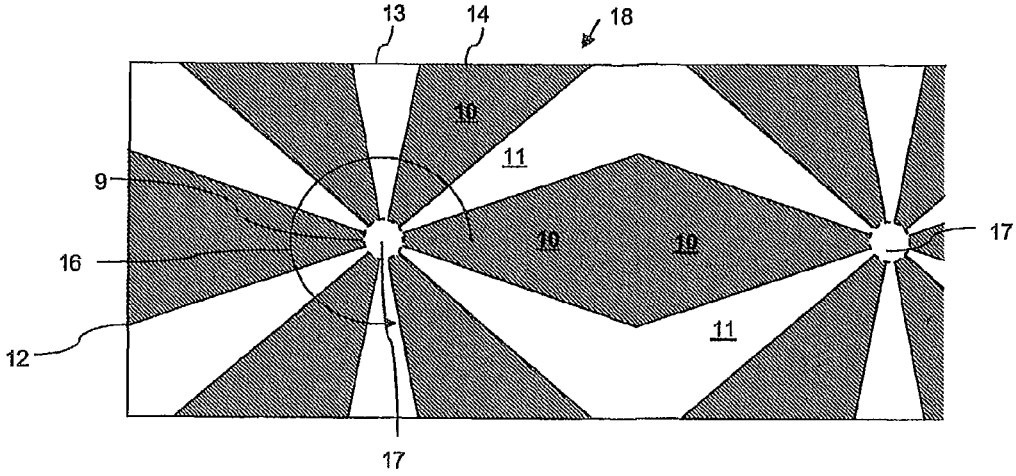
FIG. 2B shows a second exemplary embodiment of a pattern of anti-wetting sections in accordance with the present invention.

FIG. 2B shows an embodiment of a pattern 18 of anti-wetting sections 10. The pattern is applied around a nozzle 17. The pattern has an inner periphery 9 and an outer periphery 12. The inner periphery may be outside of or coincide with the border of the nozzle 17. The anti-wetting sections 10 extend from the inner periphery 9 of the pattern to the outer periphery 12 of the pattern. The anti-wetting sections 10 alternate with the wetting sections 11 on a circular line 16 concentric with the nozzle. The anti-wetting sections 10 have a width 13 at the outer periphery 12 that is larger than the width 14 of a wetting section at the outer periphery 12. The inner periphery 9 of the pattern 18 has a circular shape, whereas the outer periphery 12 of the pattern 18 has a square shape. In general, the shape of the inner periphery 9 and the outer periphery 12 may be selected suitably. All suitable shapes are deemed to be encompassed by the present invention.

Figure 2C:
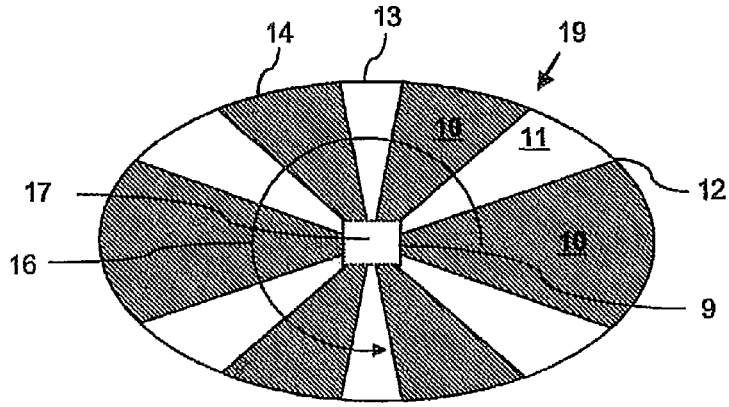
FIG. 2C shows a third exemplary embodiment of a pattern of anti-wetting sections in accordance with the present invention.

FIG. 2C shows an embodiment of a pattern 19 of anti-wetting sections 10. The pattern is applied around a nozzle 17. The pattern has an inner periphery 9 and an outer periphery 12. The inner periphery 9 may be outside of or coincide with the border of the nozzle 17. The anti-wetting sections 10 extend from the inner periphery 9 of the pattern to the outer periphery 12 of the pattern. The anti-wetting sections 10 alternate with wetting sections 11 on a circular line 16 concentric with the nozzle. The anti-wetting sections 10 have a width 13 at the outer periphery 12 that is larger than the width 14 of a wetting section 11 at the outer periphery 12. The inner periphery 9 of pattern 19 has a square shape, whereas the outer periphery 12 of the pattern 18 has an oval shape. The width 14 of an anti-wetting section 10 may vary for each anti-wetting section 10 in the pattern 19 or may be equal for each anti-wetting section 10.

It will be clear to the person skilled in the art that the above mentioned shapes of both the inner periphery 9 and the outer periphery 12 are merely exemplary of the invention. Other shapes are possible as well for the inner and the outer periphery.

Figure 3:
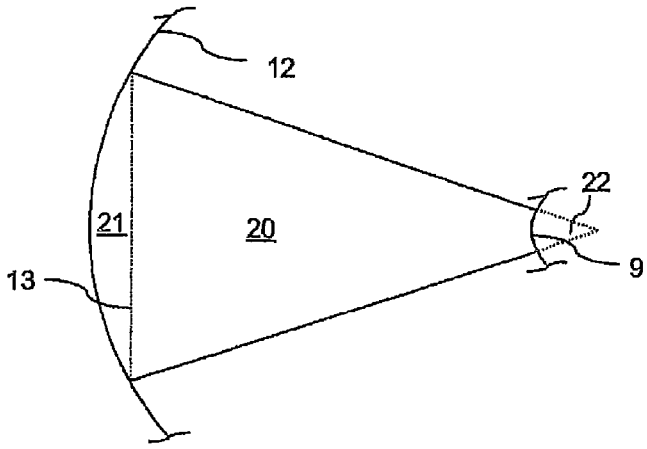
FIG. 3 shows an anti-wetting section of an embodiment of a pattern in accordance with the present invention, wherein the anti-wetting section has a substantially triangular shape.

FIG. 3 shows a fragment of an inner periphery 9 and an outer periphery 12. An anti-wetting section 20 extends from the inner periphery 9 to the outer periphery 12. The anti-wetting section 20 is substantially triangular. The width 13 of the anti-wetting section 20 varies with the distance from the outer periphery 12 and is largest at the intersection of the anti-wetting section 20 and the outer periphery 12. The shape of the anti-wetting section 20 closely resembles the shape of a triangle; if the anti-wetting section 20 would be extended virtually within the boundaries of the inner periphery 9, a purely triangular shape might be obtained (the anti-wetting section 20 extended with an inner section 22). Throughout this application, the shape of the anti-wetting section 20 may be referred to as being substantially triangular. An outer area 21 may be anti-wetting, to form a part of the anti-wetting section 20, or may be wetting. In both cases, the anti-wetting section 20 may be referred to as having a substantially triangular shape.

Figure 4A:
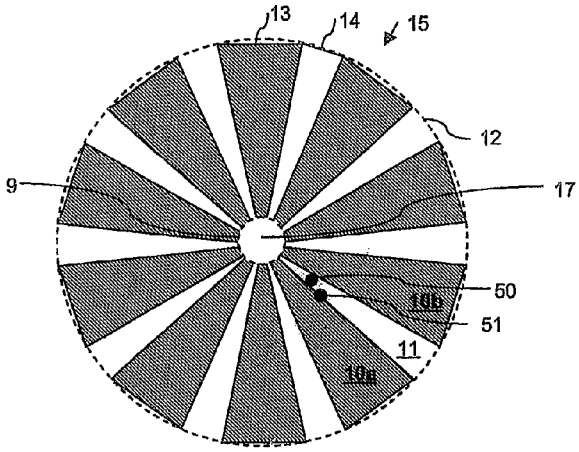
FIG. 4A-4C illustrate a droplet being driven away from a nozzle by a pattern of anti-wetting sections in accordance with the present invention.

FIG. 4A shows an embodiment of a pattern 15 comprising a first anti-wetting section 10*a*, a second anti-wetting section 10*b* and a wetting section 11. The pattern 15 is applied around a nozzle 17. The pattern 15 has an inner periphery 9 and an outer periphery 12. During jetting of ink, ink may be spilled. This ink may be present on the wetting section 11 of the pattern 15. Ink prefers the wetting section 11 over one of the anti-wetting sections 10*a*, 10*b* and will usually not move from the wetting section 11 to one of the anti-wetting sections 10*a*, 10*b*, but stay within the boundaries of the wetting section 11, as explained above. On the pattern 15, a first droplet of ink 50 and a second droplet of ink 51 are present. The first droplet 50 is present on the wetting section 11 of the pattern 15. The second droplet 51 is situated partially on the wetting section 11 and partially on the anti-wetting section 10*a*. Because of the better wettability of wetting section 11 compared to anti-wetting section 10*a*, the second droplet 51, which is in contact with both the wetting section 11 and the anti-wetting section 10*a*, will move towards the wetting section 11 to become situated within the boundaries of the wetting section 11. Once the second droplet 51 is situated within the boundaries of the wetting section 11, the droplet 51 will not move back towards an anti-wetting section 10*a*, 10*b*. In this way, the pattern comprising alternating wetting sections 11 and anti-wetting sections 10*a*, 10*b*, provides a means for collecting droplets of ink on the wetting sections 11 of the pattern 15.

Because the droplets stay within the boundaries of the wetting section 11, the maximum size of a droplet, that may be accommodated on a wetting section 11, depends on the width of the wetting section 11 at the location of the droplet. Since the width of a wetting section 11 increases with increasing distance from the inner periphery 9 of the pattern 15, smaller droplets 50, 51 may be accommodated on a part of the wetting section close to the inner periphery 9 of the pattern.

Figure 4B:
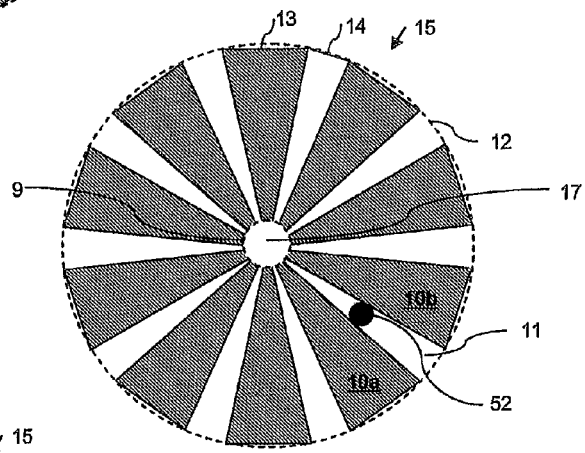

FIG. 4B shows the same pattern 15 as described with respect to FIG. 4A. On the wetting section 11 of the pattern 15, a droplet 52 is present. The droplet 52 may have been formed, for example by merging of the first droplet 50 and the second droplet 51, which are shown in FIG. 4A. The droplet 52 is larger than each of the first droplet 50 and the second droplet 51. As a consequence, the droplet 52 cannot be positioned on a position in the wetting section 11, where the width of the wetting section 11 is smaller than the size of the droplet 52, but has to be positioned on a part of the wetting section 11, which has a width that is at least as large as the size of the droplet 52. Because the width of the wetting section 11 increases with increasing distance from the inner periphery 9, the droplet 52 is positioned further away from the inner periphery 9 than the first droplet 50 and the second droplet 51. Thus, by increasing size of a droplet, the droplet moves away from the inner periphery 9 of the pattern. Therefore, the width of the wetting section 11 at the outer periphery 12 of the pattern should be at least the width of the wetting section 11 at the inner periphery 9 of the pattern. If the width of the wetting section 11 at the outer periphery 12 would be smaller than the width of the wetting section 11 at the inner periphery 9, no driving force would be provided to move droplets away from the inner periphery 9.

Figure 4C:
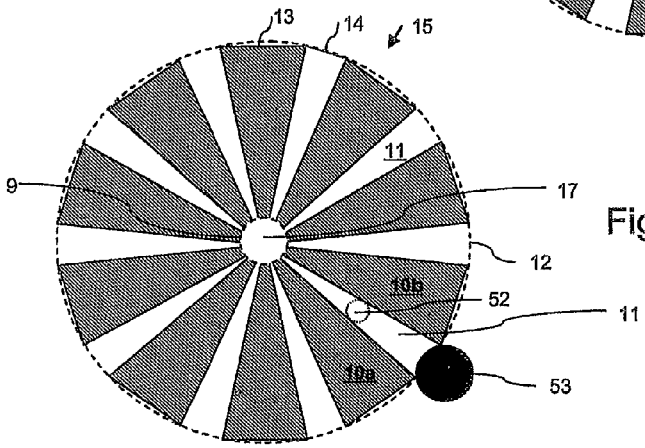

FIG. 4C shows the same pattern 15 as described with respect to FIG. 4A and FIG. 4B. A droplet 53 is present, partially on the pattern. The droplet 53 may have been formed by merging of droplet 52 (shown in a dotted line) with other droplets of ink (not shown). The droplet 53 is larger than the droplet 52 and as a consequence, the droplet 53 is positioned further away from the inner periphery 9 than the droplet 52. In fact, the droplet 53 has become too large to be completely positioned on the wetting section 11 of the pattern 15, but instead, is positioned partially outside of the outer periphery 12 of the pattern 15.

In summary, the shape of both the wetting sections 11 and the anti-wetting sections 10 of the pattern 15 provide means for retaining a droplet of ink away from the inner periphery 9 of the pattern 15 and thus, to retain ink away from the nozzle, and provides a driving force to move droplets present on a nozzle surface further away from the nozzle, upon increasing size of the droplet.

Figure 5:
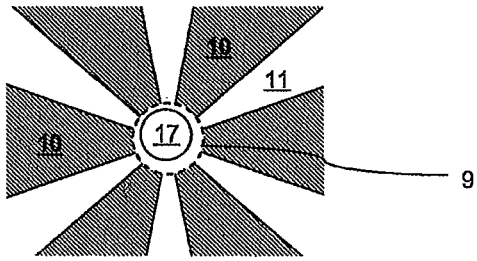
FIG. 5 shows a part of a pattern of anti-wetting sections in accordance with an embodiment of the present invention, wherein the inner periphery is circular.

FIG. 5 shows a part of a pattern of anti-wetting sections, comprising an inner periphery 9 that is circular. The pattern comprises an anti-wetting section 10 and a wetting section 11. The anti-wetting section 10 interchanges on a circular line, concentric with the inner periphery of the pattern, with a wetting section 11. The anti-wetting section 10 extends from the inner periphery 9 to an outer periphery (not shown).

The inner periphery 9 is circular. A nozzle 17 is confined within the boundaries of the inner periphery 9 of the pattern. The distance between the nozzle 17 and the inner periphery 9 may be equal on all points on the inner periphery 9 or may differ with different positions on the inner periphery 9. In case the distance between the nozzle 17 and the inner periphery 9 is equal for all points on the inner periphery, the distance may be either zero or may be larger than zero. The distance between the nozzle 17 and the inner periphery 9 may be suitably selected.

Figure 6:
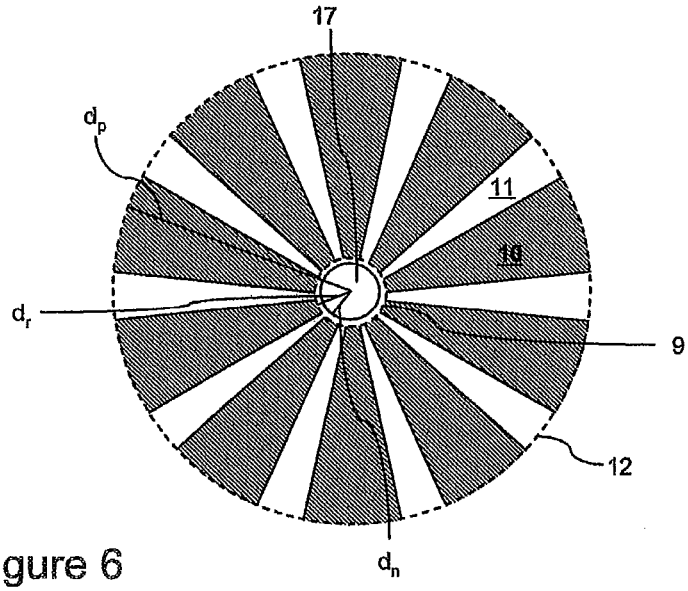
FIG. 6 shows a pattern in accordance with an embodiment of the present invention, wherein the inner periphery and the outer periphery are concentric with a nozzle.

FIG. 6 shows a pattern of anti-wetting sections 10. The pattern is applied around a nozzle 17. The pattern has an inner periphery 9 and an outer periphery 12. The inner periphery may be outside of or coincide with the border of the nozzle 17. The anti-wetting sections 10 extend from the inner periphery 9 of the pattern to the outer periphery 12 of the pattern. In this embodiment, the nozzle 17 has a circular shape and a radius $d_n$. The inner periphery 9 has a circular shape and a radius $d_r$. The centre of the nozzle 17 coincides with the centre of the inner periphery 9. Hence, the nozzle 17 and the inner periphery 9 are concentric. The outer periphery 12 of the pattern is circular and has a radius $d_p$. Like the inner periphery 9, the outer periphery 12 is concentric with the nozzle 17. Hence, also the inner periphery 9 and the outer periphery 12 are concentric. Since both peripheries 9 and 12 are concentric with the nozzle 17, the whole pattern is concentric with the nozzle 17. Therefore, the distance between the inner periphery 9 and the outer periphery 12 is the same throughout the pattern. As a consequence, irrespective of the position of a droplet on the pattern, a droplet of ink travels a same distance to move outside of the pattern.

Figure 7A:
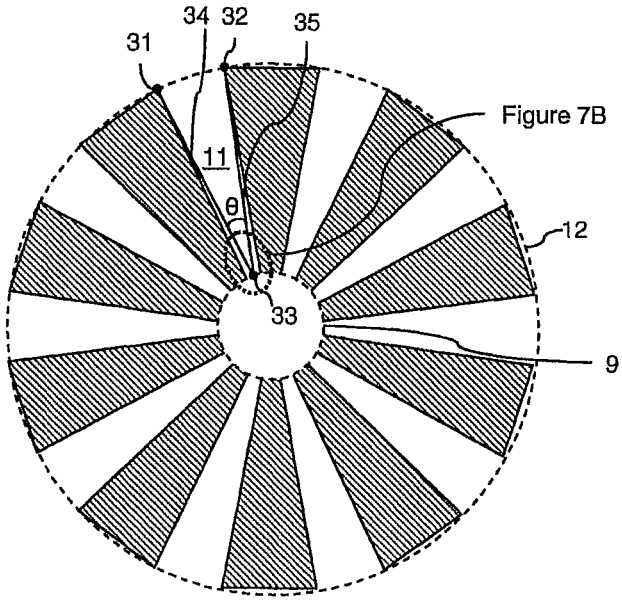
FIG. 7A shows an embodiment of a pattern in accordance with the present invention.

FIG. 7A shows a pattern comprising a number of anti-wetting sections 10, each shown as dashed sections. The pattern has an inner periphery 9 and an outer periphery 12. On a line concentric with the inner periphery (not shown), the anti-wetting section 10 interchanges with a wetting section 11. The anti-wetting section 10 extends from the inner periphery 9 to the outer periphery 12. A first and a second outer border point 31 and 32 are defined, which are located on the outer periphery 12 adjacent to a respective anti-wetting section. A center point 33 is defined, which is located on the inner periphery 9 of the pattern. Two virtual lines are located in the wetting section 11, a first virtual line 34 extending from the first outer border point 31 to the center point 33 and a second virtual line 35 extending from the second outer border point 32 to the center point 33. An angle θ is the angle between the first and the second virtual lines 34 and 35. The angle θ may be chosen suitably. However, the angle θ is larger than 0. If the angle θ would be 0, there would be no anti-wetting section 10 interchanging with a wetting section 11 at the outer periphery 12. Thus the pattern would not generate a driving force for droplets of ink to move from the inner periphery 9 to the outer periphery 12. The maximum angle θ depends on various parameters, which are the number of wetting sections N, the radius of the outer periphery $d_p$ and the radius of the inner periphery $d_r$. The angle θ should be smaller than the maximum value for the angle θ, which is defined as:

$$\theta_{max} = 2\arctan\left[\sin\left(\frac{\pi}{2N}\right)\Big/\left(\cos\left(\frac{\pi}{2N}\right) - \frac{d_r}{d_p}\right)\right].$$

If the angle θ would exceed $\theta_{max}$, the width of a wetting section 11 at the outer periphery would be larger than the width of an anti-wetting section 10 at the outer periphery. If the angle θ equals $\theta_{max}$, then the width of the anti-wetting section 10 at the outer periphery 12 would be equal to the width of a wetting section 11 at the outer periphery. The smaller the angle θ, the smaller is the width of the wetting section 11. The driving force experienced by a droplet of ink to move from the inner periphery 9 to the outer periphery 12, depends on the angle θ. For smaller droplets, a smaller θ may be optimal; small droplets may not move to the outer periphery 12 if the width of the wetting section (distance between two adjacent anti-wetting sections) is too large. Also other parameters, such as nature of the ink, nature of the anti-wetting coating, etc, may influence the optimal value for angle θ.

Figure 7B:
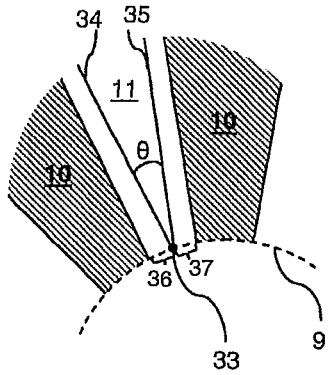
FIG. 7B shows an enlargement of a detail of FIG. 7A.

FIG. 7B shows a detail of FIG. 7A. FIG. 7B shows a part of a wetting section 11. The width of the wetting section 11 at the inner periphery 9 is limited and larger than 0. A center point 33 is located on the inner periphery 9. The first distance 36 from the center point 33 to one of the adjacent anti-wetting sections equals the distance 37 from the center point 33 to the other one of the adjacent anti-wetting sections 10. As a consequence, the center point 33 is located in the middle between the two adjacent anti-wetting sections 10.

Figure 8A:
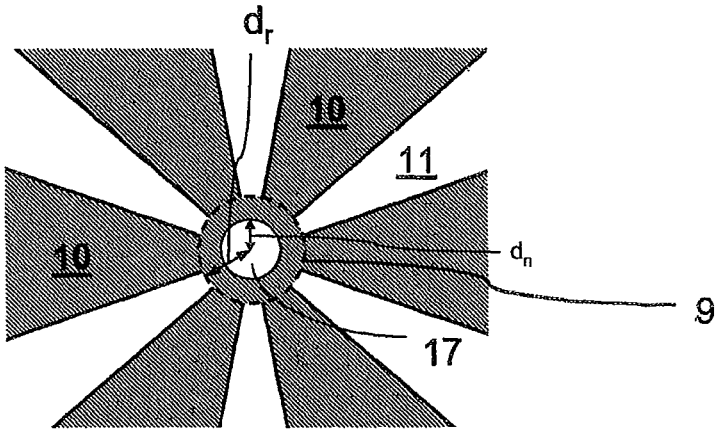
FIG. 8A shown an exemplary embodiment of a part of a pattern in accordance with the present invention.

FIG. 8A shows a pattern of number of wetting sections 11 and a number of anti-wetting sections 10, the anti-wetting sections 10 being shown as dashed sections. The pattern has an inner periphery 9, which is located around a nozzle 17. The radius of the nozzle $d_n$ is smaller than the radius of the inner periphery $d_r$ of the pattern. The area confined by the inner periphery 9 of the pattern and the nozzle 17 is anti-wetting. As explained above, ink has little interaction with an anti-wetting surface and does not spread out on an anti-wetting surface. Thus, in this embodiment, ink does not spread in the area directly surrounding the nozzle 17, but will form a droplet having a small contact area with the anti-wetting area surrounding the nozzle 17. A droplet present in this area, may migrate to one of the wetting sections 11 of the pattern and may migrate further away from the nozzle, as was explained in more detail above with reference to FIG. 4A-FIG. 4C.

Figure 8B:
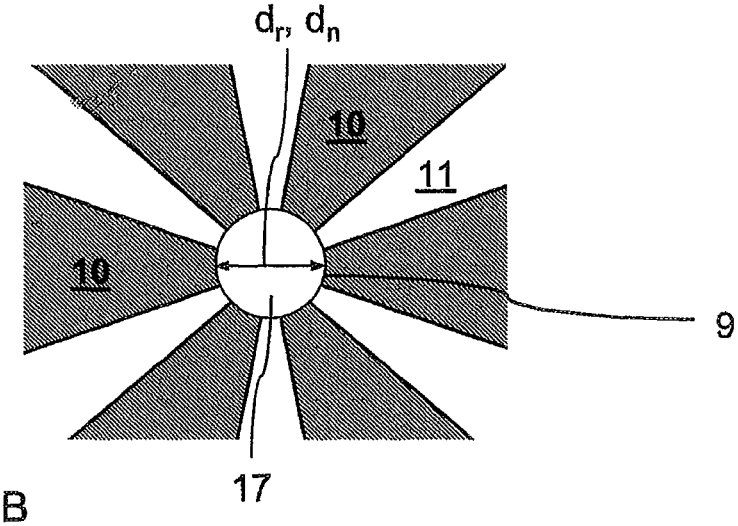
FIG. 8B shows an exemplary embodiment of a part of a pattern in accordance with the present invention.

FIG. 8B shows a pattern of a number of wetting sections 11 and a number of anti-wetting sections 10, the anti-wetting sections 10 being shown as dashed sections. The pattern has an inner periphery 9, which is located around a nozzle 17. The radius of the nozzle $d_o$ is equal to the radius of the inner periphery $d_r$ of the pattern. As a consequence, the inner periphery 9 of the pattern borders to the nozzle. A droplet of ink present on the nozzle surface may be confined within the boundaries of one of the number of wetting sections 11 of the pattern and upon increasing size of the droplet, may move away from the inner periphery 9 of the pattern and may eventually be transported to an area outside the outer periphery 12 of the pattern.

Figure 8C:
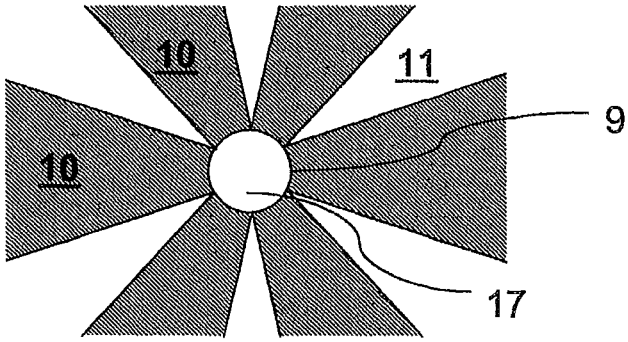
FIG. 8C shows an exemplary embodiment of a part of a pattern in accordance with the present invention.

FIG. 8C shows a pattern of a number of wetting sections 11 and a number of anti-wetting sections 10, the anti-wetting sections 10 being shown as dashed sections. The pattern has an inner periphery 9, which is located around a nozzle 17. The pattern also comprises an outer periphery (not shown). The width of a wetting section 11 at the inner periphery 9 of the pattern is zero. As a consequence, the part of the wetting section in close proximity to the inner periphery 9 has a small width. Only very small droplets may be positioned on the wetting section 11 in close proximity to the inner periphery 9. Larger droplets will move directly towards a part of the wetting section 11 further away from the inner periphery 9. Hence, a pattern, wherein the width of the wetting section 11 is zero at the inner periphery, prevents droplets from being in close proximity to the nozzle 17 and removes the droplets towards the outer periphery 12 of the pattern more efficiently.

Any of these embodiments of a pattern of anti-wetting sections in accordance with the present invention shown in FIGS. 8A-8C may be suitably selected and/or combined with other embodiments. Moreover, also other suitable embodiments of a pattern of anti-wetting sections in accordance with the present invention are deemed to be encompassed by the present invention.

Figure 9:
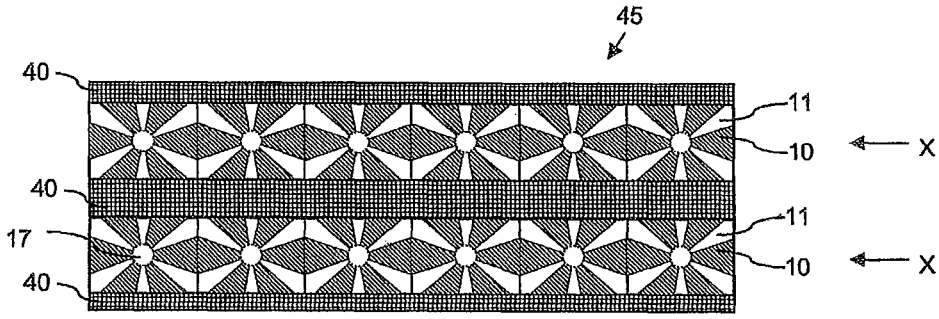
FIG. 9 shows an exemplary embodiment of a nozzle surface in accordance with the present invention.

FIG. 9 shows a nozzle surface 45, having arranged thereon two rows X of nozzles 17.

Around each nozzle 17 a pattern of anti-wetting sections 10 and wetting sections 11 is arranged. As shown above, each pattern provides a driving force to remove droplets away from the nozzle 17. However, once a droplet of ink has moved to an area outside of the outer periphery of the pattern, the ink should not move back towards the nozzle 17. Therefore, the area 40 of the nozzle surface 45, outside of the outer periphery of the pattern should not provide a driving force for droplets of ink to move back towards a nozzle 17. Therefore, the area 40 of the nozzle surface outside of the outer periphery of the pattern may be at least as wettable as the wetting section 11 of the pattern. Preferably, the area 40 of the nozzle surface outside of the outer periphery of the pattern, may be more wettable than a wetting section 11 of the pattern. In this way, an additional driving force is provided to remove droplets of ink away from a nozzle 17. Once a droplet of ink is moved towards an area of the nozzle surface 40, which is more wettable than a wetting section 11 of the pattern, the droplet of ink may be subsequently removed from the nozzle surface 45 by suitable means, for example a wiper. For example, a wiper may wipe from one edge of the nozzle surface 45 to another edge of the nozzle surface in the direction of a row of nozzles X. The further the wiper moves over the nozzle surface 45, the more ink is engaged by the wiper. The ink engaged by the wiper should not move towards a nozzle 17. By applying an area 40 on the nozzle surface 45, which is more wettable than the wetting section 11 of the pattern, ink will stay on the more wettable surface 40, instead of moving across the outer periphery of a pattern and move towards a nozzle, when wiping. In this way, it is prevented that a droplet of ink, spilled on the nozzle surface 45 may interfere with the nozzle 17 and may deteriorate the jetting properties of said nozzle 17.

Detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually and appropriately detailed structure. In particular, features presented and described in separate dependent claims may be applied in combination and any combination of such claims are herewith disclosed. Further, the terms and phrases used herein are not intended to be limiting; but rather, to provide an understandable description of the invention. The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly.

The invention claimed is:

1. A print head configured for ejecting droplets of ink, said print head having a nozzle surface, said nozzle surface comprising a nozzle and a pattern arranged around the nozzle, the pattern comprising an anti-wetting section and a wetting section, and the pattern having an inner periphery and an outer periphery, the anti-wetting section and the wetting section each extending from the inner periphery to the outer periphery, the anti-wetting section alternating, on a circular line concentric with the nozzle, with the wetting section, wherein the anti-wetting section has a width at the outer periphery larger than a width of a wetting section at the outer periphery.

2. A print head according to claim 1, wherein the anti-wetting section is substantially triangular.

3. A print head according to claim 1, wherein the inner periphery is circular.

4. A print head according to claim 3, wherein the outer periphery is circular.

5. A print head according to claim 4, wherein the pattern is concentric with respect to said nozzle.

6. A print head according to claim 5, wherein the nozzle has a radius $d_n$ and the inner periphery of the pattern has a radius $d_r$, said radius $d_n$ of the nozzle being smaller than said radius $d_r$ of the inner periphery of the pattern.

7. A print head according to claim 6, wherein the area confined by the inner periphery of the pattern of anti-wetting material and the nozzle is anti-wetting.

8. A print head according to claim 4, wherein the outer periphery of the pattern has a radius $d_p$ and the inner periphery has a radius $d_r$, said pattern comprising a number N of wetting sections, and wherein each wetting section has a center point located on the inner periphery of the pattern, and a first and a second outer border point located on the outer periphery of the pattern adjacent to a respective anti-wetting section, two virtual lines being located in the wetting section, a first virtual line extending from the first outer border point to the center point and a second virtual line extending from the second outer border point to the center point and wherein an angle θ is defined as the angle between the first and the second virtual lines and wherein $$0 < \theta < 2\arctan\left[\sin\left(\frac{\pi}{2N}\right) \Big/ \left(\cos\left(\frac{\pi}{2N}\right) - \frac{d_r}{d_p}\right)\right].$$

9. A print head according to claim 8, wherein the wetting section has a limited width on the inner periphery of the pattern and wherein the center point is located on the inner periphery in the middle of two adjacent anti-wetting sections.

10. A print head according to claim 3, wherein the radius $d_n$ of the nozzle and the radius $d_r$ of the inner periphery of the pattern are equal.

11. A print head according to claim 1, wherein the width of a wetting section at the inner periphery is zero.

12. A print head according to claim 1, wherein a part of the nozzle surface outside of the outer periphery of the pattern of anti-wetting sections around a nozzle is as wettable as or more wettable than the wetting section of said pattern.

13. Printing apparatus, comprising a nozzle plate according to claim 1.

* * * * *